US007625055B2

(12) United States Patent
Furuya

(10) Patent No.: US 7,625,055 B2
(45) Date of Patent: Dec. 1, 2009

(54) LIQUID DROPLET EJECTION APPARATUS

(75) Inventor: Masami Furuya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 406 days.

(21) Appl. No.: 11/499,564

(22) Filed: Aug. 4, 2006

(65) Prior Publication Data

US 2007/0206040 A1 Sep. 6, 2007

(30) Foreign Application Priority Data

Mar. 3, 2006 (JP) ..... 2006-058640

(51) Int. Cl.
*B41J 29/38* (2006.01)

(52) U.S. Cl. ..... 347/9; 347/14; 347/19

(58) Field of Classification Search ..... 347/8, 347/9, 14, 19
See application file for complete search history.

(56) References Cited

U.S. PATENT DOCUMENTS 5,719,602 A * 2/1998 Hackleman et al. ..... 347/14
7,237,858 B2 * 7/2007 Igarashi ..... 347/8

FOREIGN PATENT DOCUMENTS

JP 11-170623 6/1999
JP 11170623 A * 6/1999

OTHER PUBLICATIONS

Machine translation of description of drawings of JP 11-170623 A.*
Machine translation of detailed description of JP 11-170623 A.*

* cited by examiner

*Primary Examiner*—Matthew Luu
*Assistant Examiner*—Justin Seo
(74) *Attorney, Agent, or Firm*—Fildes & Outland, P.C.

(57) ABSTRACT

A liquid droplet ejection apparatus includes a conveyor unit that conveys a recording medium, liquid droplet ejection head that records an image by ejecting liquid droplets onto the recording medium conveyed by the conveyor unit, and a controller that increases or decreases ejection timing of the liquid droplet ejection head in amounts equal to a correction time determined based on conveyance speed data of the conveyor unit such that a shift amount generated in a period from when the liquid droplet is ejected to when the liquid droplet lands on the recording medium becomes constant with respect to a reference position.

7 Claims, 12 Drawing Sheets

FIG.7

| CLOCK NUMBER | 0 | 1 | 2 | 3 | 4 | 5 | 6 | |
|---|---|---|---|---|---|---|---|---|
| A. CONVEYANCE SPEED mm/sec | 762.000 | 762.127 | 762.253 | 762.380 | 762.506 | 762.633 | 762.759 | ------ |
| B. PRINTING CLOCK μs | 55.556 | 55.546 | 55.537 | 55.528 | 55.519 | 55.509 | 55.500 | ------ |
| C. LANDING SHIFT CORRECTION TIME μs | 0.000 | -0.042 | -0.083 | -0.125 | -0.166 | -0.207 | -0.249 | ------ |
| D. SHIFT AMOUNT μm | 0.0000 | -0.0316 | -0.0633 | -0.0949 | -0.1266 | -0.1582 | -0.1899 | ------ |
| E. CORRECTED PRINTING CLOCK μs | 55.514 | 55.505 | 55.496 | 55.486 | 55.477 | 55.468 | 55.459 | ------ |

LIQUID DROPLET EJECTION APPARATUS

BACKGROUND

1. Technical Field

The present invention relates to a liquid droplet ejection apparatus that ejects liquid droplets.

2. Related Art

As liquid droplet ejection apparatus, inkjet recording apparatus are known which conduct printing on paper by causing the paper to be attracted to an endless conveyor belt, conveying the paper to the underside of inkjet recording heads, and ejecting ink droplets onto the paper from the inkjet recording heads.

The endless conveyor belt is stretched around a drive roll and a driven roll, and is circulated and driven (rotates) as a result of the drive roll being caused to rotate.

In the inkjet recording apparatus, the conveyor belt is driven by the drive roll. Thus, when the drive roll becomes eccentric due to manufacturing condition or the like, variations may arise in the conveyance speed of the conveyor belt. Accordingly, the conveyance speed of the conveyor belt may vary at the time the ink droplets are ejected. For this reason, shifts in the positions of the ink droplets landing on the recording medium can arise. The quality of the image to be formed on the recording medium changes due to the affects of these positional shifts of the ink droplets.

Moreover, because the way in which variations in the speed of the conveyor belt at the time the ink droplets are ejected arise differs per page of the recording medium, shifts in the landing positions of the ink droplets become varied per page, and image quality variations arise between the pages of the recording medium. Further, such variations in image quality that arise between the pages become more pronounced the faster the conveyance speed is.

SUMMARY

One aspect of a liquid droplet ejection apparatus of the present invention comprises: a conveyor unit that conveys a recording medium; liquid droplet ejection heads that record an image by ejecting liquid droplets onto the recording medium conveyed by the conveyor unit; and a controller that increases or decreases an ejection timing of the liquid droplet ejection head by a correction time determined based on conveyance speed data of the conveyor unit such that an amount of shift of the liquid droplets with respect to a reference position during a period from when the liquid droplets are ejected to when the liquid droplet land on the recording medium become constant.

BRIEF DESCRIPTION OF THE DRAWINGS

Embodiments of the present invention will be described in detail based on the following figures, wherein:

FIG. 7 is a diagram showing a data table of printing clocks and corrected printing clocks pertaining to the first embodiment of the invention;

DESCRIPTION

Exemplary embodiments of a liquid droplet ejection apparatus pertaining to the present invention will be described below on the basis of the drawings.

FIRST EXEMPLARY EMBODIMENT

Figure 1:
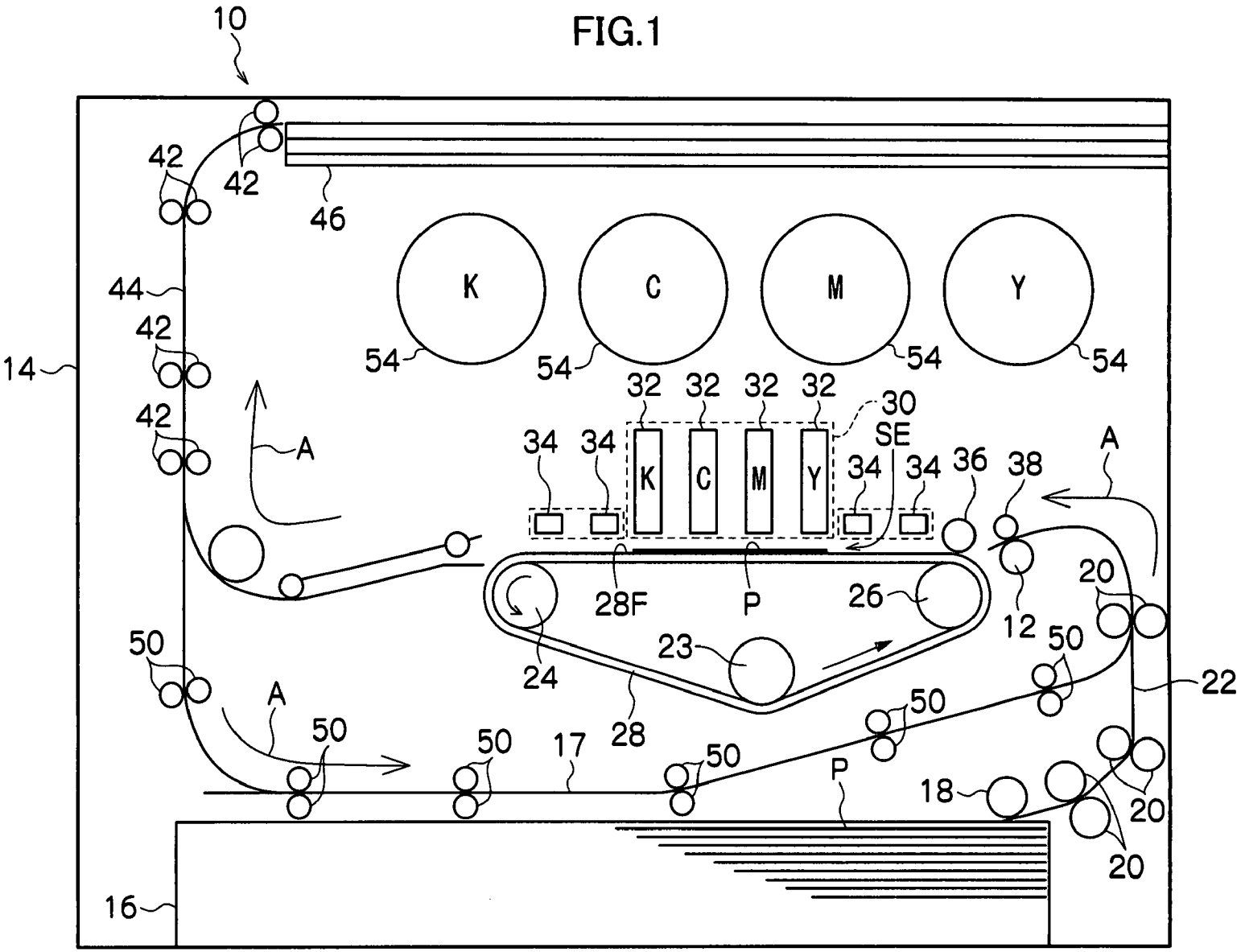
FIG. 1 is a diagram showing the overall configuration of an inkjet recording apparatus pertaining to a first embodiment of the invention.

FIG. 1 shows the overall configuration of an inkjet recording apparatus 10 pertaining to the first exemplary embodiment.

The inkjet recording apparatus 10 includes a casing 14 in whose lower portion a paper tray 16, in which sheets of paper (recording medium) P are stacked, is disposed. The sheets of paper P are picked up one sheet at a time by a feed roll 18. The picked-up paper P is conveyed downstream (direction A in FIG. 1; this direction will be called "the conveyance direction A" below) by plural conveyance roll pairs 20 that configure a predetermined conveyance path 22.

An endless conveyor belt 28 is disposed above the paper tray 16. The conveyor belt 28 is stretched around a drive roll 24, which is rotatingly driven in one direction (counter-clockwise direction in FIG. 1), a driven roll 26, and a tension roll 23. The tension roll 23 presses the conveyor belt 28 in the direction from the inner periphery to the outer periphery of the conveyor belt 28 (downward in FIG. 1), whereby constant tension is imparted to the conveyor belt 28. Further, the conveyor belt 28 rotates (is circulated and driven) in one direction (counter-clockwise direction in FIG. 1) by the rotational force of the drive roll 24.

The circumferential length of the drive roll 24 is configured to be, for example, 80 mm and the length of the conveyor belt 28 is configured to be, for example, 690 mm, that being a length that can feed three sheets of A4-size paper P with the long side thereof as the leading edge.

A recording head array 30 is disposed above the conveyor belt 28 and faces a flat portion 28F of the conveyor belt 28. This region, where the recording head array 30 faces the flat portion 28F of the conveyor belt 28, serves as an ink droplet ejection region SE where ink droplets (liquid droplets) are ejected from the recording head array 30. The paper P conveyed on the conveyance path 22 is retained and conveyed by the conveyor belt 28 to the ink droplet ejection region SE, where ink droplets corresponding to image information are ejected onto the paper P from the recording head array 30 and adhere to the paper P in a state where the paper P faces the recording head array 30.

In the present embodiment, the recording head array 30 is configured as a long recording head array such that its effective recording region is equal to or greater than the width of the paper P (i.e., the length of the paper P in the direction orthogonal to the conveyance direction A). The recording head array 30 includes four inkjet recording heads (liquid droplet ejection heads) 32 that correspond to the four colors of yellow (Y), magenta (M), cyan (C), and black (K) and are disposed along the conveyance direction A, whereby the recording head array 30 is capable of recording a full-color image.

A controller 62 that drives and controls the inkjet recording heads 32 is connected to each of the inkjet recording heads 32. The controller 62 is configured to determine ink ejection ports (nozzles) that are to be used in accordance with the image information, determine, as will be described later, ejection timings at which the inkjet recording heads 32 eject the ink droplets, and send drive signals to the inkjet recording heads 32 (see FIG. 3).

A charge roll 36, to which a power supply is connected, is disposed upstream of the recording head array 30. The charge roll 36 follows the rotation of the driven roll 26 while nipping the conveyor belt 28 and the paper P between itself and the driven roll 26, and is configured to be movable between a pressing position where the charge roll 36 presses the paper P against the conveyor belt 28 and a separated position where the charge roll 36 is separated from the conveyor belt 28. Because a predetermined potential difference arises between the charge roll 36 and the grounded driven roll 26 in the pressing position, the charge roll 36 imparts electrical charge to the paper P to cause the paper P to be electrostatically attracted to the conveyor belt 28.

A registration roll 12, which feeds the paper P to the conveyor belt 28, and a driven roll 38, which is disposed facing the registration roll 12, are disposed upstream of the charge roll 36.

The registration roll 12 includes a skew correcting function that corrects skewing of the paper P by aligning the position of the leading end of the paper P. In this skew correcting function, the leading end of the paper P is introduced from one end portion to the other end portion in the width direction (i.e., direction orthogonal to the conveyance direction A) to a nip portion formed between the registration roll 12 and the driven roll 38, and when the leading end of the paper P has become orthogonal to the conveyance direction A, the registration roll 12 is driven to convey the paper P. Thus, skewing of the paper P is corrected.

A separation plate (not shown) is disposed downstream of the recording head array 30. The separation plate separates the paper P from the conveyor belt 28. The separated paper P is conveyed by plural discharge roll pairs 42, which configure a discharge path 44 downstream of the separation plate, and is discharged to a paper discharge tray 46 disposed in the upper portion of the casing 14.

An inversion path 17 configured by plural inversion-use roll pairs 50 is disposed between the paper tray 16 and the conveyor belt 28. When an image has been recorded on one side of the paper P, the paper P is inverted and retained on the conveyor belt 28, so that an image can be easily recorded on the other side of the paper P.

Ink tanks 54 that respectively store inks of the aforementioned four colors are disposed between the conveyor belt 28 and the paper discharge tray 46. The inks inside the ink tanks 54 are supplied to the recording head array 30 by unillustrated ink supply tubes. Various types of known inks can be used as the inks, such as water-based inks, oil-based inks, and solvent inks.

Figure 2:
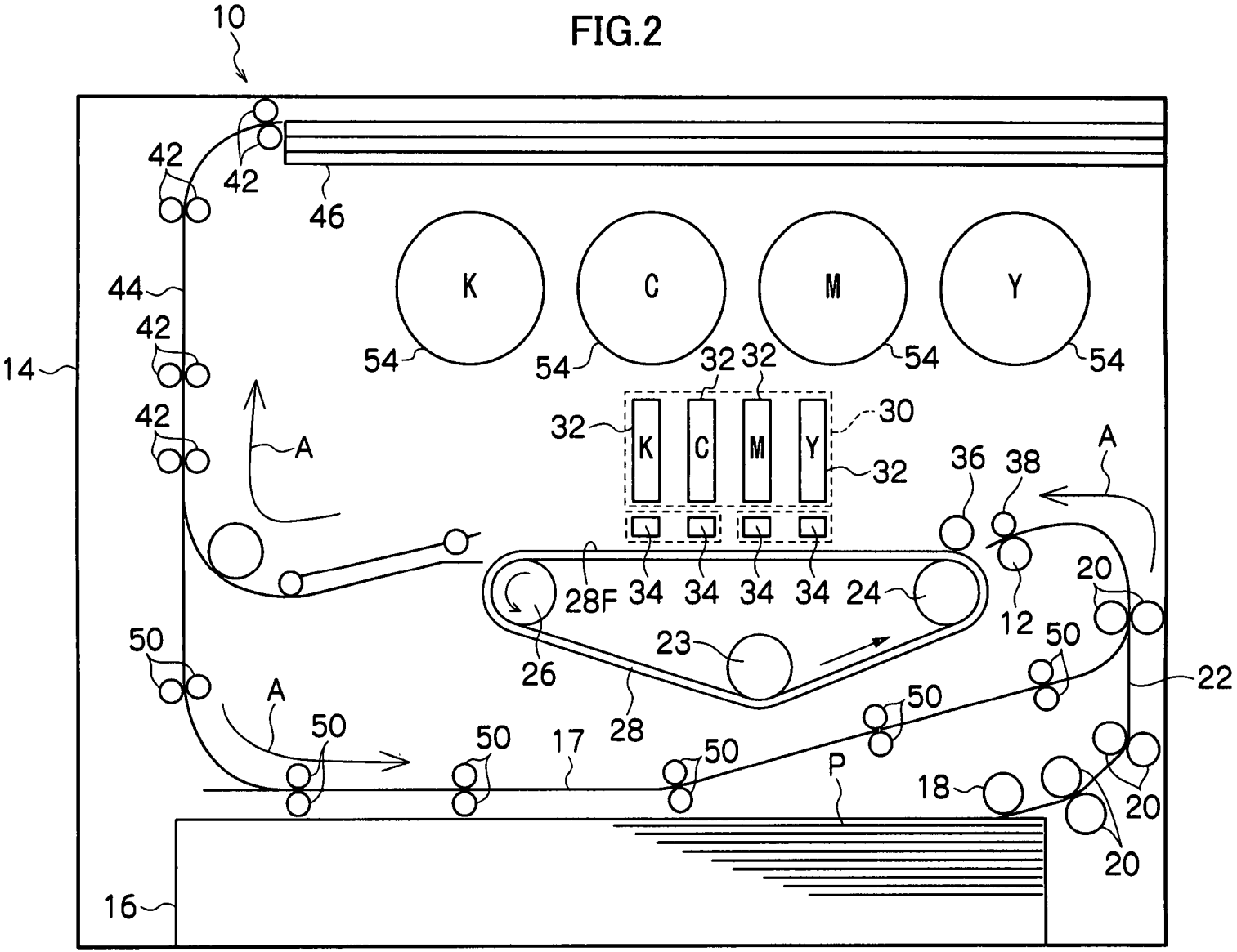
FIG. 2 is a diagram showing maintenance in the inkjet recording apparatus pertaining to the first embodiment of the invention.

A total of four maintenance units 34 corresponding to the inkjet recording heads 32 are disposed on both sides of the recording head array 30. As shown in FIG. 2, when maintenance is to be conducted with respect to the inkjet recording heads 32, the recording head array 30 moves upward and the maintenance units 34 move into a gap formed thereby between the recording head array 30 and the conveyor belt 28. Then, the maintenance units 34 conduct predetermined maintenance (vacuuming, dummy jetting, wiping, capping, etc.) in a state where the maintenance units 34 face nozzle faces of the inkjet recording heads 32.

Next, a configuration that controls ejection timings at which the inkjet recording heads 32 eject the ink droplets will be described.

Figure 3:
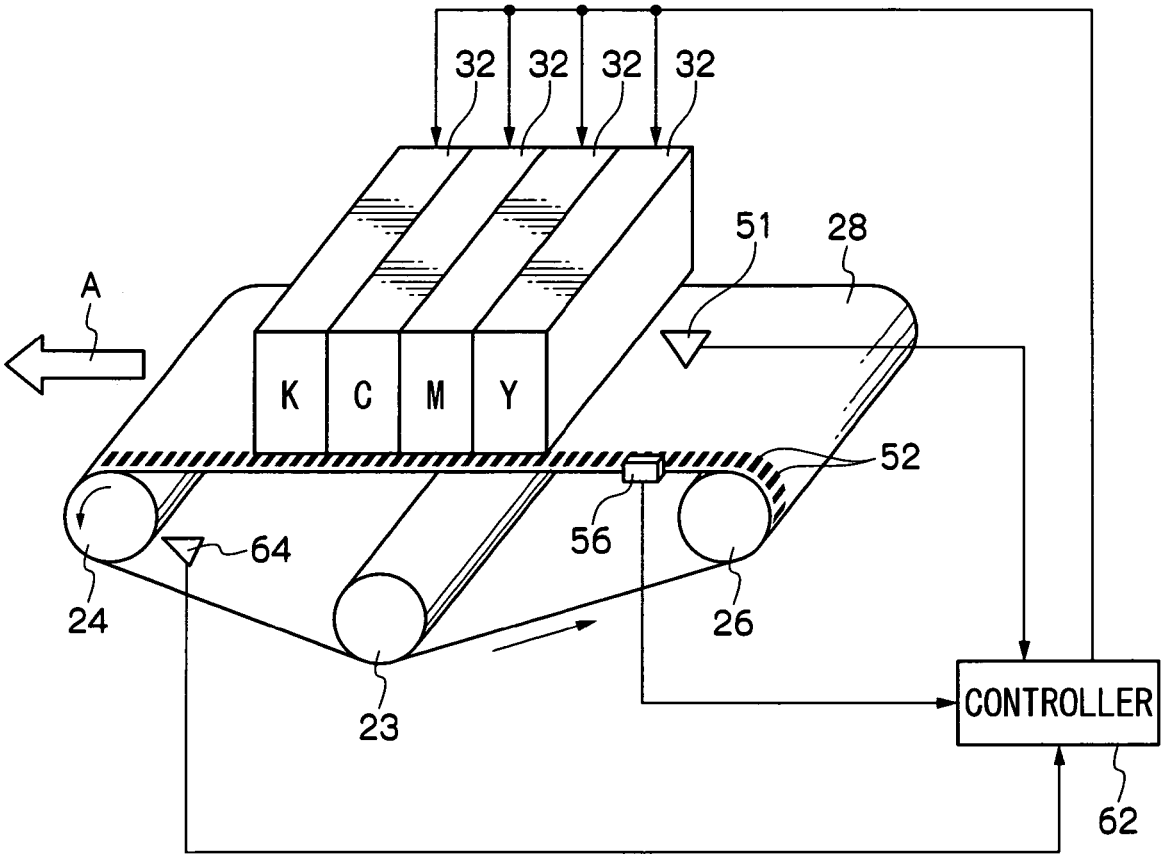
FIG. 3 is a diagram showing the configuration of a conveyor belt and its vicinity pertaining to the first embodiment of the invention.
Figure 4:
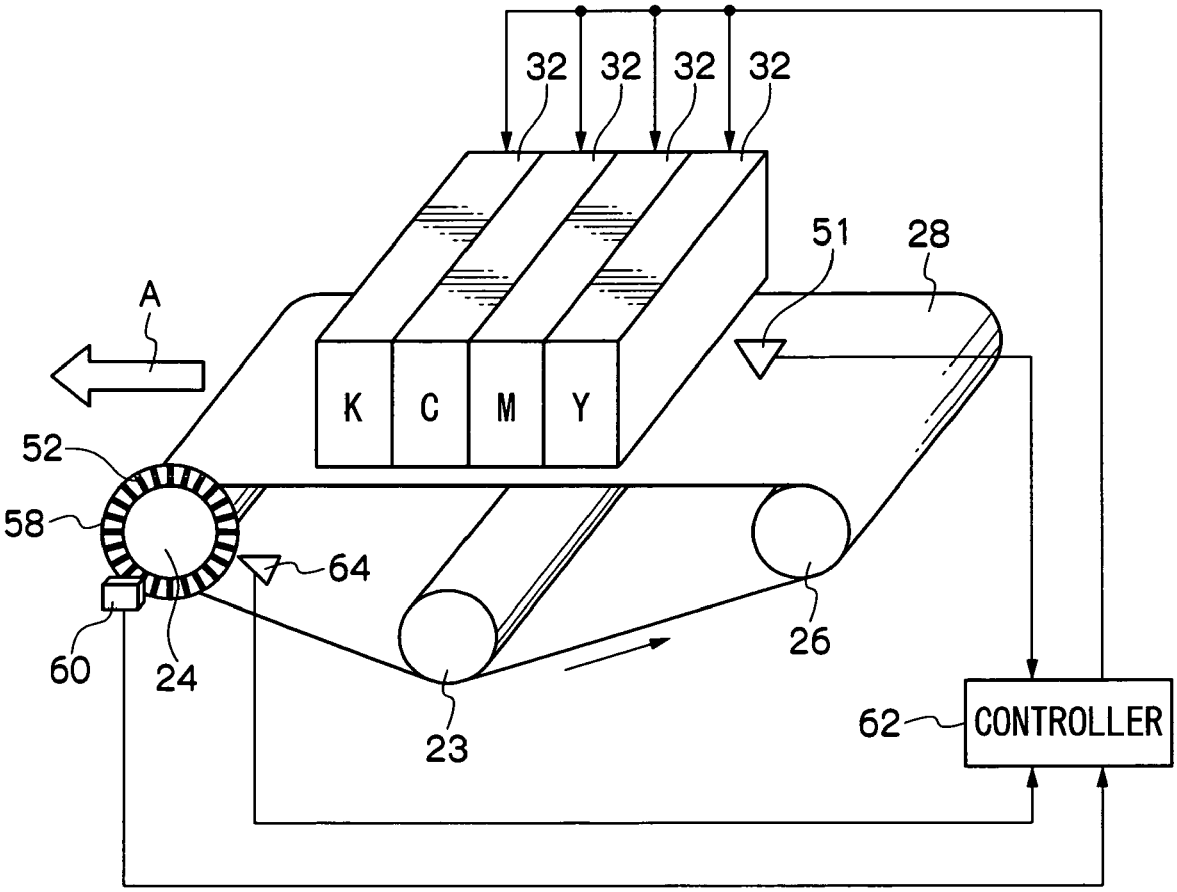
FIG. 4 is a diagram showing a modification where ejection timing-use marks pertaining to the first embodiment of the invention are disposed on a drive roll.

As shown in FIG. 3, an entrance sensor 51 that detects the leading end of the paper P is disposed above the conveyor belt 28 at a position upstream of the inkjet recording heads 32.

The controller 62 is connected to the entrance sensor 51. When the entrance sensor 51 detects the leading end of the paper P, the entrance sensor 51 inputs a detection signal to the controller 62.

Further, ejection timing-use marks 52, which are used in order to control the ejection timings of the ink droplets, are plurally disposed along the rotational direction (circumferential direction) on one end portion (position where the paper P is not placed) of the conveyor belt 28 in the rotational axis direction (direction orthogonal to the circumferential direction) of the conveyor belt 28. The ejection timing-use marks 52 are added at equidistant intervals, and the intervals between the ejection timing-use marks 52 are the same as the resolution of the inkjet recording apparatus 10 in the conveyance direction A. Thus, the moving amount of the conveyor belt 28 can be detected with a precision equal to the resolution.

It will be noted that the intervals between the ejection timing-use marks 52 may be several times the resolution of the inkjet recording apparatus 10 in the conveyance direction A, that is the intervals between the ejection timing-use marks 52 may be spaced more roughly than the resolution.

Further, the ejection timing-use marks 52 may be configured such that, rather than being disposed in one row, they are disposed in multiple rows. In this case, for example, the intervals between the ejection timing-use marks 52 disposed in single rows may be an N multiple (where N is an integer of 2 or greater) of the resolution, and N rows of the ejection timing-use marks 52 may be disposed on the conveyor belt 28 parallel to each other and mutually shifted one pixel in the conveyance direction. Further, slits may be disposed in the conveyor belt 28 instead of the ejection timing-use marks 52.

A reading sensor 56 that reads the ejection timing-use marks 52 is disposed on one end portion of the conveyor belt 28 in the rotational axis direction at a position upstream of the inkjet recording heads 32. The reading sensor 56 is configured to detect the ejection timing-use marks 52 each time one of the ejection timing-use marks 52 passes a predetermined position when the conveyor belt 28 rotates.

The controller 62 is connected to the reading sensor 56, and each time the reading sensor 56 detects one of the ejection timing-use marks 52, the reading sensor 56 inputs a detection signal to the controller 62.

The controller 62 measures the input intervals of the detection signals that are inputted each time one of the ejection timing-use marks 52 passes the predetermined position—that is, the amount of time from when one of the ejection timing-use marks 52 passes the predetermined position to when the next ejection timing-use mark 52 passes the predetermined position—and detects these measured amounts of time as printing clocks that serve as a reference for the ejection timings.

Further, the controller 62 counts the number of clocks of the printing clocks by counting the detection signals that are inputted each time one of the ejection timing-use marks 52 passes the predetermined position, so that the controller 62 detects the moving amount of the conveyor belt 28.

According to the above configuration, first, the paper P that is fed on the basis of a printing command (image recording command) from a user or the like is introduced to the conveyor belt 28. Then, when the leading end of the paper P passes below the entrance sensor 51, the entrance sensor 51 detects the leading end of the paper P and inputs the detection signal to the controller 62 (see FIG. 5). When this detection signal is inputted to the controller 62, the controller 62 counts, using the detection signal as a starting point, the number of clocks (number of ejection timing-use marks 52 that have passed the predetermined position) of the printing clocks inputted from the reading sensor 62.

The distances from the entrance sensor 51 to the nozzles of each of the inkjet recording heads 32 (see L1 to L4 in FIG. 5) are regulated by predetermined design values, and the timing at which the paper P is conveyed directly below the nozzles in the ink droplet ejection region SE is understood by counting the number of clocks of the printing clocks. When there are differences, with respect to set values, in the distances from the entrance sensor 51 to the nozzles of each of the inkjet recording heads 32 due to manufacturing variation or the like, then the controller 62 conducts correction control by increasing or decreasing the predetermined number of clocks.

Figure 5:
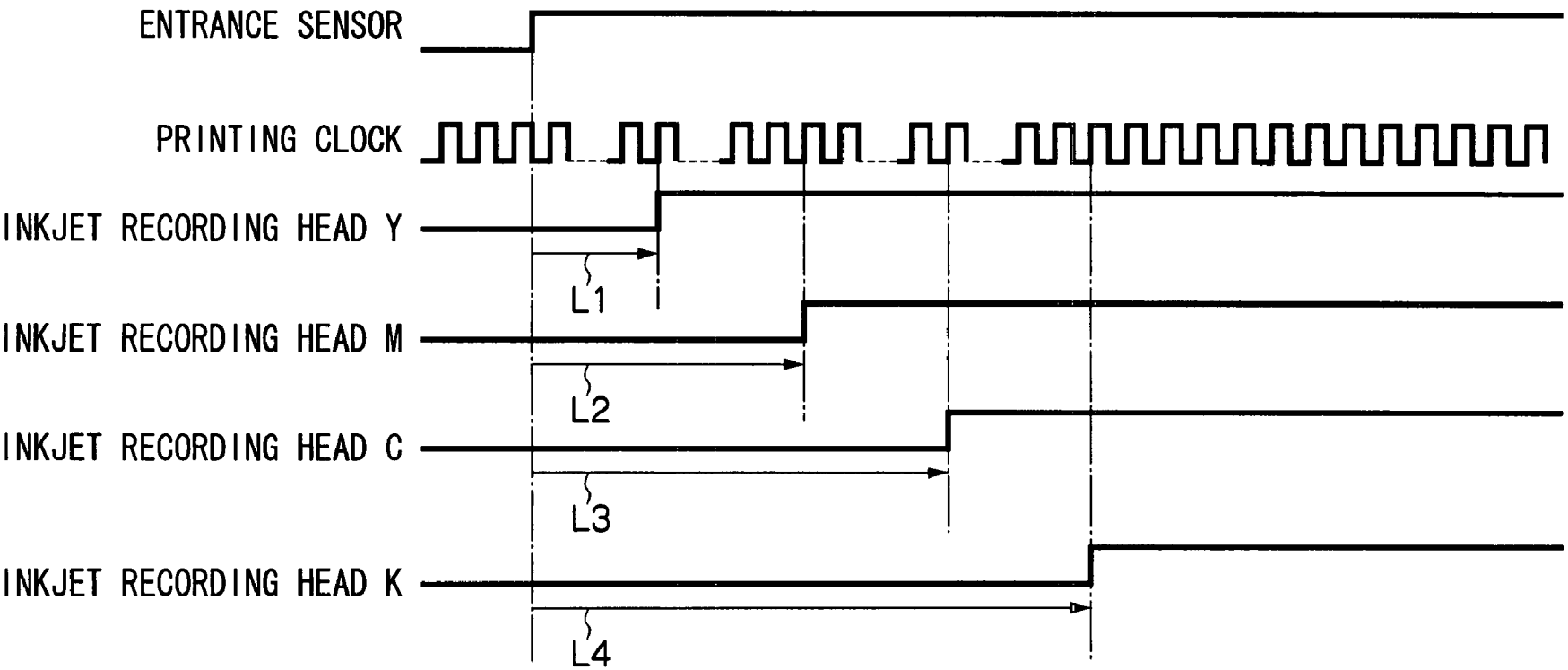
FIG. 5 is a diagram showing ejection timings of inkjet recording heads pertaining to the first embodiment of the invention.

In FIG. 5, L1 represents the distance from the entrance sensor 51 to the nozzles of the yellow inkjet recording head 32, L2 represents the distance from the entrance sensor 51 to the nozzles of the magenta inkjet recording head 32, L3 represents the distance from the entrance sensor 51 to the nozzles of the cyan inkjet recording head 32, and L4 represents the distance from the entrance sensor 51 to the nozzles of the black inkjet recording head 32.

As shown in FIG. 5, the controller 62 generates ejection start timings and sends a drive signal to each of the inkjet recording heads 32 by counting the number of clocks of the printing clocks. Thus, each of the inkjet recording heads 32 starts ejecting the ink droplets, and an image corresponding to the image information is recorded on the paper P.

Further, a home mark (not shown) is added to one place on the outer peripheral surface of the drive roll 24. As shown in FIG. 3, a home sensor 64 that reads the home mark (not shown) is disposed on the outer periphery of the drive roll 24.

The home sensor 64 is connected to the controller 62, and when the home sensor 64 detects the home mark, the home sensor 64 inputs a detection signal to the controller 62. Thus, the fact that the drive roll 24 has reached a predetermined rotational position (home position) is detected by the controller 62.

It will be noted that the inkjet recording apparatus 10 may also be configured such that, instead of the ejection timing-use marks 52 being disposed on the conveyor belt 28, an encoder film 58, to which the ejection timing-use marks 52 have been added, is disposed on one end portion of the drive roll 24 in the rotational axis direction. In this configuration, the encoder film 58 is disposed coaxially with the drive roll 24 and rotates integrally with the drive roll 24. Similar to the configuration where the ejection timing-use marks 52 are disposed on the conveyor belt 28, the ejection timing-use marks 52 here are added to the encoder film 58 at equidistant intervals along the circumferential direction of the drive roll 24, and the intervals between the ejection timing-use marks 52 are the same as the conveyance-direction resolution of the inkjet recording apparatus 10.

Further, an encoder sensor 60 that reads the ejection timing-use marks 52 is disposed at one end portion of the drive roll 24 in the rotational axis direction. The encoder sensor 60 is connected to the controller 62, and each time the encoder sensor 60 detects one of the ejection timing-use marks 52, the encoder sensor 60 inputs a detection signal to the controller 62.

According to this configuration, the controller 62 can control, in the same manner as when the ejection timing-use marks 52 are disposed on the conveyor belt 28, the ejection timings at which the inkjet recording heads 32 eject the ink droplets.

Figure 6:
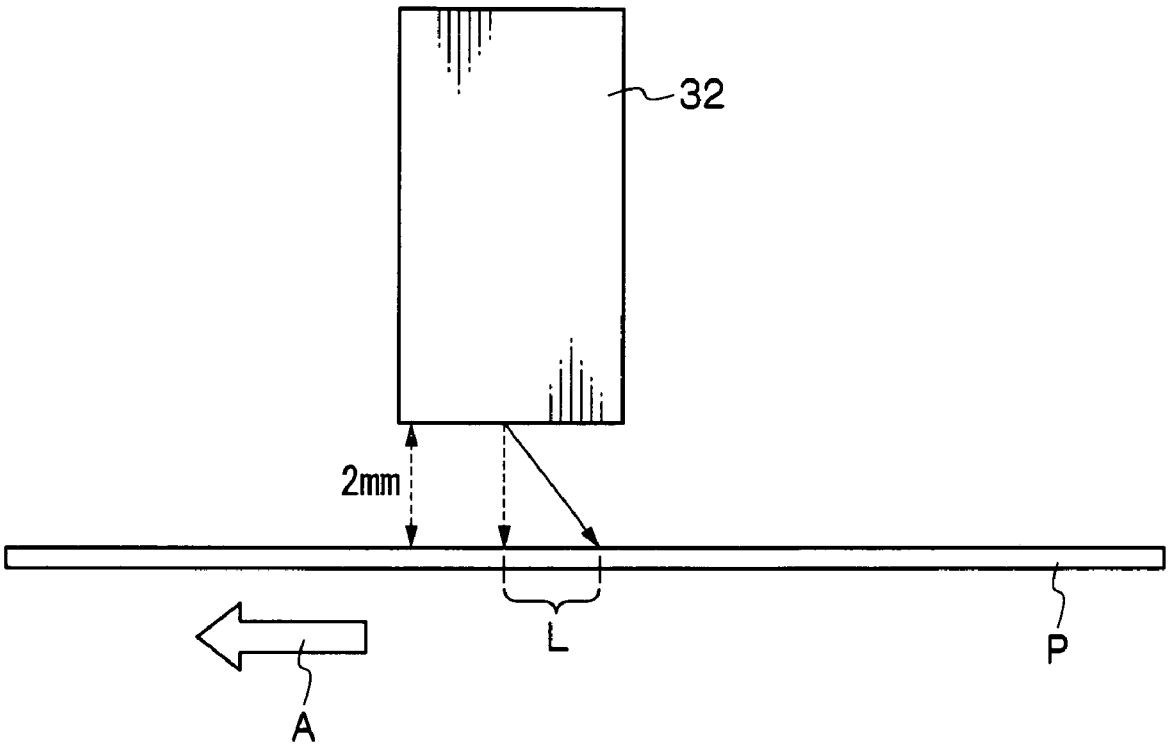
FIG. 6 is a diagram showing a shift in the landing position of ink which arises in the inkjet recording apparatus pertaining to the first embodiment of the invention.

In the inkjet recording apparatus 10 pertaining to the present embodiment when the recording resolution is 600 dpi and the inkjet recording heads 32 are driven at a head drive frequency of 18 KHz, the belt conveyance speed of the conveyor belt 28 becomes 762 mm/sec. When the inkjet recording heads 32 eject the ink droplets onto the paper P at a speed of 8000 mm/sec and the distance between the underside of the inkjet recording heads 32 and the surface of the paper P is 2 mm, the positions where the ink droplets actually land on the paper P after they are ejected become shifted 190 μm along the conveyance direction A from positions on the paper P which face the inkjet recording heads 32 at the exact timings when the ink droplets are ejected, as shown in FIG. 6 (see L in FIG. 6).

The conveyance speed of the conveyor belt 28 varies due to the drive roll 24 eccentricity. When a difference of ±5%, for example, is present in the conveyance speed of the conveyor belt 28, the landing positions of the ink droplets vary in the range of ±10 μm with respect to a reference landing position where the ink droplets land when the conveyance speed of the conveyor belt 28 is a predetermined value. Consequently, the landing positions become shifted a maximum of 200 μm, from the position that faced heads 32 at the exact timings when the ink droplets are ejected, when a difference of ±5% is present in the conveyance speed of the conveyor belt 28. Due to this shift, effects appear in image quality such as secondary colors.

Because the way in which variations in the speed of the conveyor belt 28 arise differs for each page of the paper P when the inkjet recording heads 32 eject the ink droplets, shifts in the landing positions of the ink droplets become vary depending on the page, and image quality variations arise between the pages of the paper P.

A configuration will be described which controls the ejection timings of the inkjet recording heads 32 on the basis of conveyance speed data of the conveyor belt 28 such that the amount of shift in the position where the ink droplets land on the paper P becomes constant with respect to a reference position.

In the present embodiment, an example will be described where the ejection timings of the inkjet recording heads 32 are controlled on the basis of a data table, created beforehand, to cause the shift amount of landing position on the paper P, that is generated from when the ink droplets are ejected from the inkjet recording heads 32 to when the ink droplets land on the paper P, to become constant with respect to a reference position.

First, conveyance speed profile data of the conveyor belt 28 for one rotation of the drive roll 24 using a predetermined rotational position (home position) on the drive roll 24 as a reference point—that is, a data table of the printing clocks of the conveyor belt 28 for one rotation of the drive roll 24 using the predetermined rotational position (home position) as a reference point—is created as follows.

In a configuration where the ejection timing-use marks 52 are added to the conveyor belt 28, in the initial stage operation when the power of the inkjet recording apparatus 10 is turned ON, the conveyor belt 28 is driven and the ejection timing-use marks 52 are read by the reading sensor 56 for a unit of one rotation of the drive roll 24, with the predetermined rotational position (home position) serving as a reference point.

The intervals at which the ejection timing-use marks 52 read by the reading sensor 56 pass the predetermined position—that is, the printing clocks—are detected. And, as shown in FIG. 7, a data table of each detected printing clock (see row B in FIG. 7) and the conveyance speeds (see row A in FIG. 7) of the conveyor belt 28 for each clock, calculated by dividing the distance between the ejection timing-use marks 52 by the printing clocks, is created. It will be noted that the above-described reading may also be implemented several times to create an averaged data table.

Further, as another example of the method of creating the data table, the speed of the conveyor belt 28 may be measured beforehand, such as at the time of manufacture by a surface speedometer or the like, to create a data table of the printing clocks and the conveyance speeds of the conveyor belt 28 for each clock.

Next, landing shift correction times for correcting the landing position shifts of the ink droplets are calculated by the expression of: ((the preset conveyance speed of the conveyor belt 28÷the conveyance speed of the conveyor belt 28 actually measured)−1)×(the ejection distance from the surface of the paper P to the ejection face of the inkjet recording heads÷the ejection speed of the ink droplets).

In the present embodiment, the preset value of the conveyance speed of the conveyor belt 28 is 762 mm/sec, the ejection distance from the surface of the paper P (in the case of plain paper) to the ejection face of the inkjet recording heads 32 is 2 mm, and the ink ejection speed is 8000 mm/sec. Thus, the expression becomes ((762÷actually measured conveyance speed of the conveyor belt 28 at each clock)−1)×(2÷8000).

At the first clock, the conveyance speed of the conveyor belt 28 per clock is 762.127 mm/sec, for example. Thus, the landing shift correction time is calculated by the above expression as −0.042 μs (see row C in FIG. 7). It will be noted that the shift amount of the ink droplet landing position in the first clock becomes −0.0316 μm (see row D in FIG. 7).

Further, at the second clock, the conveyance speed of the conveyor belt 28 per clock is 762.253 mm/sec, for example. Thus, the landing shift correction time is calculated by the above expression as −0.083 μs (see row C in FIG. 7). It will be noted that the shift amount of the ink droplet landing position at the second clock becomes −0.0633 μm (see row D in FIG. 7).

Next, corrected printing clocks are created with respect to the printing clocks in the data table in consideration of the landing shift correction times (see row E in FIG. 7). These corrected printing clocks are calculated by: printing clock−landing shift correction time at the present printing clock+landing shift correction time at the next printing clock.

Figure 8:
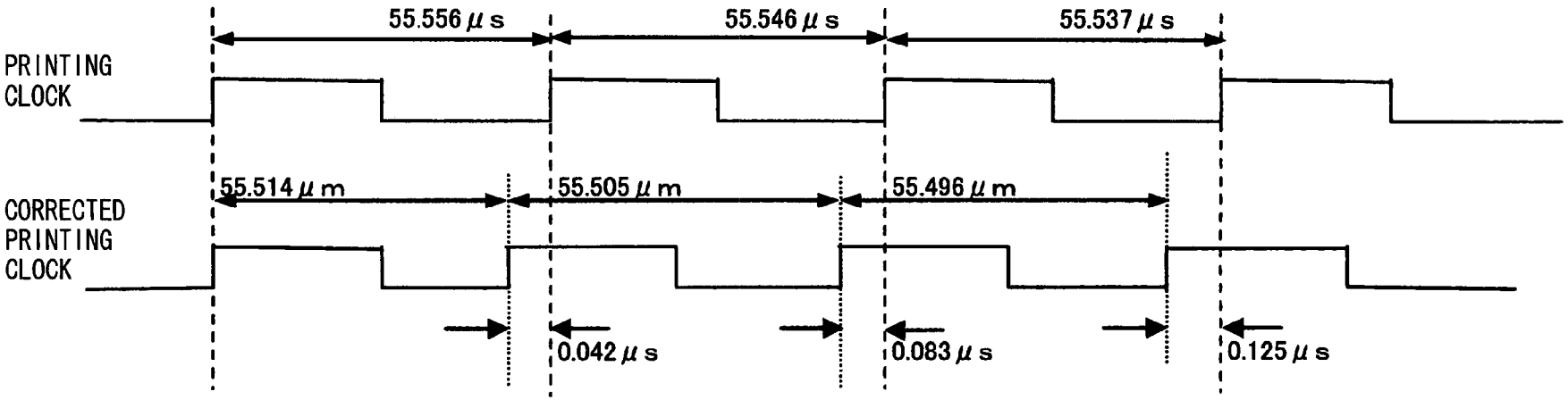
FIG. 8 is a diagram showing the relationship between the printing clocks and the corrected printing clocks pertaining to the first embodiment of the invention.

In the $0^{th}$ clock, the printing clock is 55.556 μs, for example, the landing shift correction time in the $0^{th}$ clock is 0.0 μs, and the landing shift correction time at the next first clock is −0.042 μs. Thus, the corrected printing clock is calculated by the above expression as 55.514 μs (see row E in FIG. 7; FIG. 8).

Further, at the first clock, the printing clock is 55.546 μs, for example, the landing shift correction time at the first clock is −0.042 μs, and the landing shift correction time at the next second clock is −0.083 μs. Thus, the corrected printing clock is calculated by the above expression as 55.505 μs (see row E in FIG. 7; FIG. 8).

Further, in the second clock, the printing clock is 55.537 μs, for example, the landing shift correction time at the second clock is −0.083 μs, and the landing shift correction time at the next third clock is −0.125 μs. Thus, the corrected printing clock is calculated by the above expression as 55.496 μs (see row E in FIG. 7; FIG. 8).

In this manner, the data table of the corrected printing clocks recalculated in consideration of the landing shift correction times is stored beforehand in the controller 62. The controller 62 counts the number of clocks using, as a reference point, the timing when the detection signal representing the detection of the home mark is inputted from the home sensor 64 to the controller 62, references the data of the corrected printing clocks corresponding to the counted number of clocks, and controls the ejection timings of the inkjet recording heads 32.

By controlling the ejection timings of the ink droplets in this manner, the controller 62 can increase or decrease the ejection timings of the liquid droplet ejection heads in amounts equal to the landing shift correction times calculated from the actually measured conveyance speed data of the conveyor belt 28 at the time of ink droplet ejection, such that the landing position shift amounts become constant with respect to the reference position.

It will be noted that, because the ejection distance from the surface of the paper P to the ejection face of the inkjet recording heads 32 will vary depending on the type of the paper P, the controller 62 adjusts the landing shift correction times and controls the ejection timings of the ink droplets of the inkjet recording heads 32 in accordance with those variations in the ejection distance.

For example, in the case of coated paper, the ejection distance becomes 1.7 mm, which is 0.3 mm smaller with respect to 2 mm in the case of plain paper. In this case, the controller 62 speeds up the ejection timings of the ink droplets of the inkjet recording heads 32 in order to keep the landing position shift amounts to be constant with respect to the reference position because the shift amounts are reduced.

It will be noted that the invention may also be configured such that plural data tables of corrected printing clocks are created in advance in accordance with paper types, so that when a user or the inkjet recording apparatus 10 selects the type of paper P on which an image is to be recorded, the ejection timings of the ink droplets of the inkjet recording heads 32 are controlled by the data table corresponding to that type of paper P.

As described above, in the present embodiment, the controller 62 controls the ejection timings of the inkjet recording heads 32 on the basis of a data table created in advance and causes the shift amounts of landing position of the ink droplets on the paper P to become constant with respect to a reference position.

Thus, for example, even if the conveyance speed of the paper P varies as a result of the drive roll 24 becoming eccentric at the time the ink droplets are ejected, the positional shifts in the ink droplets landing on the paper P always become constant with respect to a reference position. For this reason, variations in image quality that arise between pages of the paper P can be eliminated.

Further, in a case where the conveyance speed of the conveyor belt 28 is actually measured and the ejection timings of the inkjet recording heads 32 are controlled in real time, it is impossible to actually measure the conveyance speed of the conveyor belt 28 at the point in time when the liquid droplets are ejected and control the ejection timings of the inkjet recording heads 32. In contrast, in the present embodiment, because the data table that has been created in advance is used, the ejection timings of the inkjet recording heads 32 can be controlled by the landing shift correction times calculated by the conveyance speeds of the conveyor belt 28 as long as the current conveyance speed of the conveyor belt 28 is the same as the conveyance speed of the conveyor belt 28 when it was actually measured in the past and the data table was created.

In the present embodiment, the data table of the corrected printing clocks is created on the basis of the data table of the printing clocks of the conveyor belt 28 and the conveyance speeds of the conveyor belt 28 per clock corresponding to one rotation of the drive roll 24 using as a reference point the predetermined rotational position (home position), and the ejection timings of the ink droplets of the inkjet recording heads 32 are controlled on the basis of that data table.

However, the data table of the corrected printing clocks may also be created on the basis of the data table of the printing clocks of the conveyor belt 28 and the conveyance speeds of the conveyor belt 28 for each clock, using as a reference point the predetermined rotational position (home position) corresponding to the circumferential length of the conveyor belt 28, rather than one rotation of the drive roll 24, and the ejection timings of the ink droplets of the inkjet recording heads 32 may be controlled on the basis of that data table. In this case, in place of the home sensor 64, it is necessary to add a home mark (not shown) to one place on the outer peripheral surface of the conveyor belt 28 and to dispose a home sensor that reads the home mark (not shown) on the outer periphery of the conveyor belt 28.

SECOND EXEMPLARY EMBODIMENT

A second exemplary embodiment of the present invention will be described. The same reference numerals will be given to portions that are the same as those in the first embodiment, and description of those same portions will be omitted. Further, because the overall configuration of the inkjet recording apparatus of the second embodiment is the same as that of the first embodiment, description thereof will be omitted.

In the first exemplary embodiment, the ejection timings of the ink droplets of the inkjet recording heads 32 are controlled on the basis of the data table of the corrected printing clocks created in advance, but in the second exemplary embodiment, printing clocks that serve as a reference of the ejection timings are actually measured and the ejection timings of the inkjet recording heads 32 are controlled on the basis of the actual measurement results.

Figure 9:
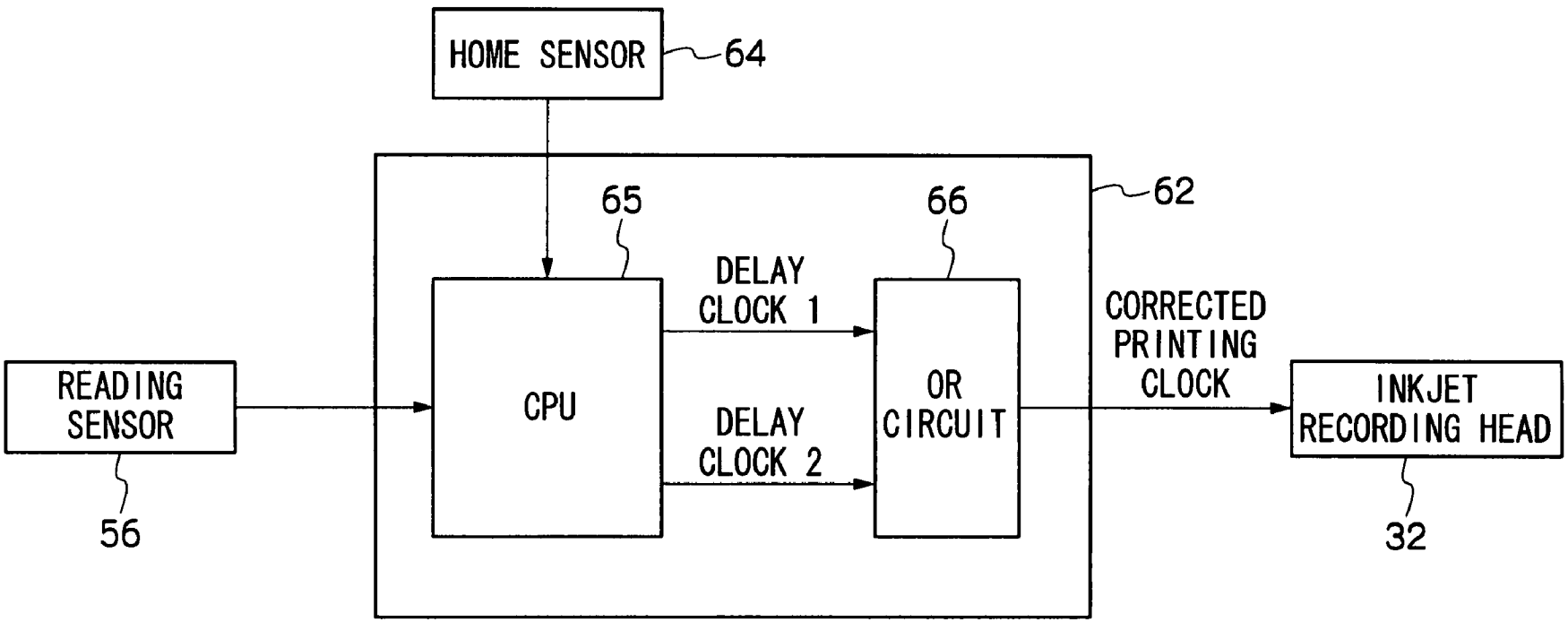
FIG. 9 is a diagram showing a control mechanism in an inkjet recording apparatus pertaining to a second embodiment of the invention.

In the second exemplary embodiment, as shown in FIG. 9, the controller 62 includes a CPU 65 that is connected to the home sensor 64 that detects that the drive roll 24 has reached the predetermined rotational position (home position), and the detection signal is inputted from the home sensor 64 to the CPU 65.

The reading sensor 56 is connected to the CPU 65, and the detection signals representing the ejection timing-use marks 52 are inputted from the reading sensor 56 to the CPU 65. The CPU 65 measures the input intervals of the detection signals that are inputted each time one of the ejection timing-use marks 52 passes the predetermined position—that is, the amount of time from when one of the ejection timing-use marks 52 passes the predetermined position to when the next ejection timing-use mark 52 passes the predetermined position—and detects these measured amounts of time as printing clocks that serve as a reference for the ejection timings. When the detection signal representing the fact that the home sensor 64 has detected the paper P is inputted to the CPU 65, this triggers the CPU 65 such that the measurement of the printing clocks is started.

Further, an OR circuit 66 is connected to the CPU 65 and is configured such that measured printing clock information is inputted as a delay clock 1 and a delay clock 2 from the CPU 65 to the OR circuit 66.

Here, the procedure of controlling the ejection timings of the inkjet recording heads 32 in the second embodiment will be described.

First, when the detection signal is inputted from the home sensor 64 to the CPU 65, this triggers the CPU 65 to measure the printing clocks.

Next, the CPU 65 calculates the landing shift correction times for correcting the landing position shifts from the measured printing clocks. The landing shift correction times are calculated by the expression: ((measured printing clock÷set value of printing clock determined in advance)−1)×(the ejection distance from the surface of the paper P to the ejection face of the inkjet recording heads 32÷the ejection speed of the ink droplets).

In the present embodiment, the set value of the printing clock is 55.5 μs, the ejection distance from the surface of the paper P (in the case of plain paper) to the ejection face of the inkjet recording heads 32 is 2 mm, and the ink ejection speed is 8000 mm/sec. Thus, the landing shift correction times are calculated by: ((measured printing clock÷55.5)−1)×(2÷8000).

Figure 10:
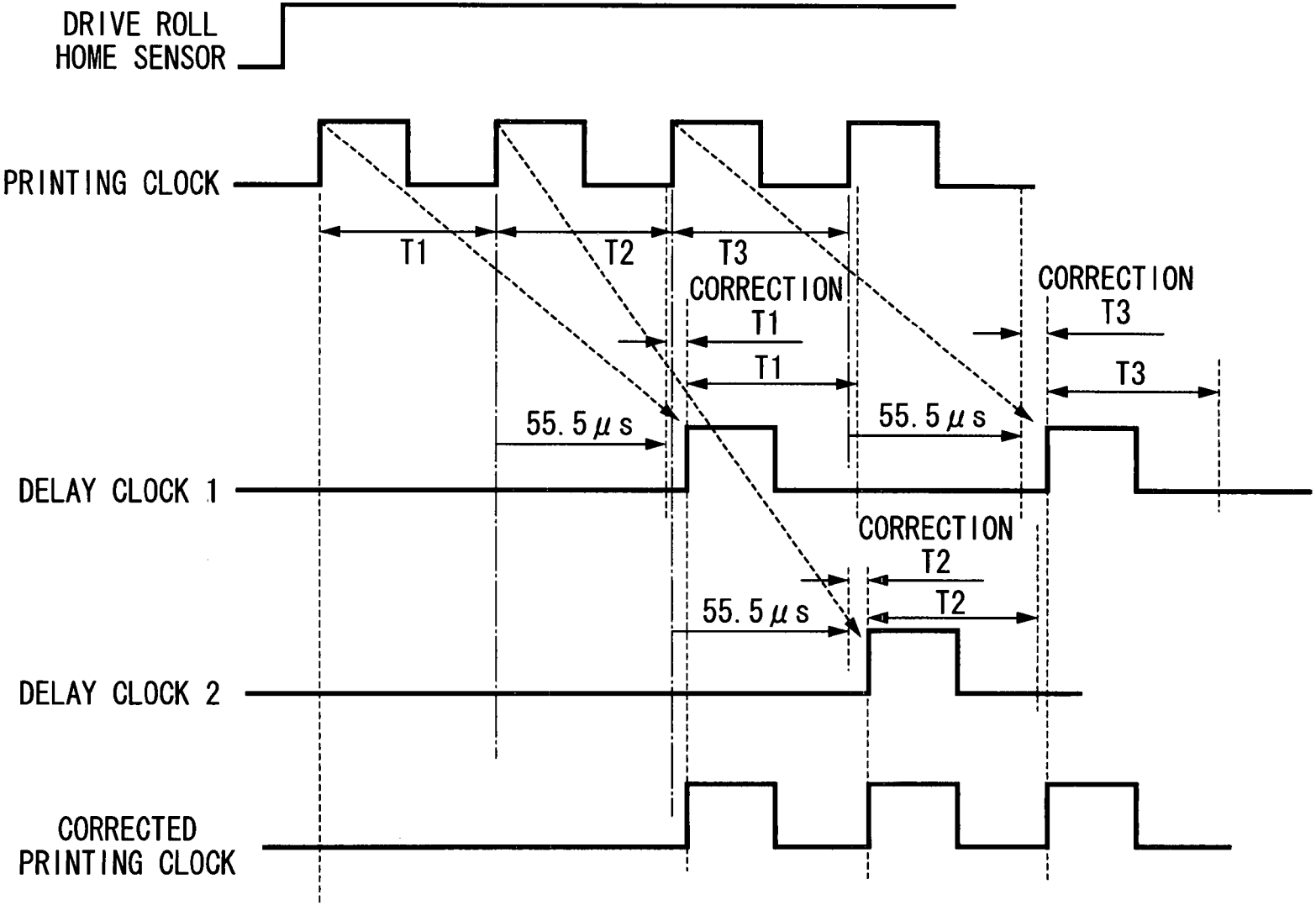
FIG. 10 is a diagram showing corrected printing clocks that are generated from printing clocks pertaining to the second embodiment of the invention.

When the firstly measured printing clock T1 becomes 56 μs, then the landing shift correction time (correction T1) becomes 2.2 μs by ((56÷55.5)−1)×(2÷8000) (see FIG. 10).

When the secondly measured printing clock T2 becomes 56.5 μs, then the landing shift correction time (correction T2) becomes 4.5 μs by ((56.5÷55.5)−1)×(2÷8000) (see FIG. 10). When the thirdly measured printing clock T3 becomes 56.6 μs, then the landing shift correction time (correction T3) becomes 4.5 μs by ((56.6÷55.5)−1)×(2÷8000) (see FIG. 10).

The first clock information of the measured printing clock (T1) is inputted from the CPU 65 to the OR circuit 66 as the delay clock 1 after being delayed an amount of time equal to the sum of the landing shift correction time (correction T1) and the set value of the printing clock that is one period of the set value of the printing clock. The second clock information of the next measured printing clock (T2) is also inputted in the same manner from the CPU 65 to the OR circuit 66 as the delay clock 2 after being delayed an amount of time equal to the sum of the landing shift correction time (correction T2) and the set value of the printing clock. That is, the sets of clock information of the measured printing clocks are alternately inputted to the OR circuit 66 as the delay clock 1 and the delay clock 2.

When the measured printing clock T1 is 56 μs, then the delay time becomes 57.7 μs as a result of adding 55.5 μs and 2.2 μs. Consequently, as shown in FIG. 10, the CPU 65 measures the printing clock T1 and inputs the clock information of the printing clock T1 as the delay clock 1 to the OR circuit 66 with being delayed for 57.7 μs.

When the printing clock T2 measured after the printing clock T1 is 56.5 μs, then the delay time becomes 60.0 μs as a result of adding 55.5 μs and 4.5 μs. Consequently, the CPU 65 measures the printing clock T2 and inputs the clock information of the printing clock T2 to the OR circuit 66 as the delay clock T2 with being delayed for 60.0 μs.

When the printing clock T3 measured after the printing clock T2 is 56.6 μs, then the delay time becomes 60.0 μs as a result of adding 55.5 μs and 4.5 μs. Consequently, the CPU 65 measures the printing clock T3 and inputs the clock information of the printing clock T3 to the OR circuit 66 as the delay clock T1 with being delayed for 60.0 μs.

When either the delay clock 1 or the delay clock 2 is inputted to the OR circuit 66, the OR circuit 66 outputs the delay clock as a corrected printing clock and determines the ejection timings of the inkjet recording heads 32.

The ejection timings of the inkjet recording heads 32 determined in accordance with the corrected printing clocks generated in this example become slower than the ejection timings determined by the printing clocks before correction.

Next, an example will be described where the measured printing clocks are faster than the set value (55.5 μs) of the printing clock.

Figure 11:
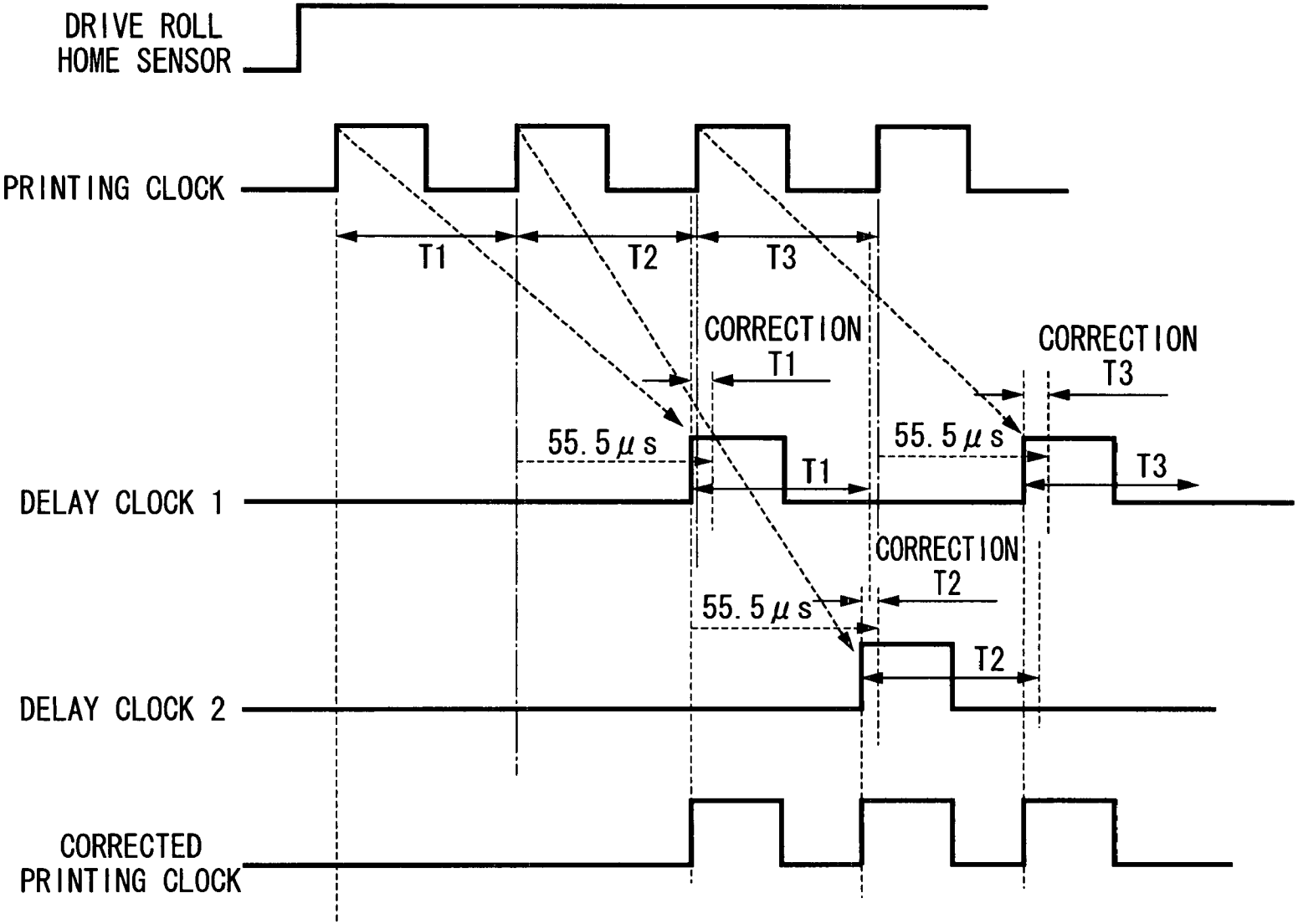
FIG. 11 is a diagram showing corrected printing clocks generated from printing clocks pertaining to the second embodiment of the invention, and shows a case where the printing clocks are faster than a set value.

When the firstly measured printing clock T1 becomes 55 μs, which is faster than the set value (55.5 μs) of the printing clock, then the landing shift correction time (correction T1) becomes −2.2 μs by ((55÷55.5)−1)×(2÷8000) (see FIG. 11).

When the secondly measured printing clock T2 becomes 54.5 μs, then the landing shift correction time (correction T2) becomes −4.5 μs by ((54.5÷55.5)−1)×(2÷8000) (see FIG. 11). When the thirdly measured printing clock T3 becomes 54.3 μs, then the landing shift correction time (correction T3) becomes −5.4 μs by ((54.3÷55.5)−1)×(2÷8000) (see FIG. 11).

When the printing clock T1 is 56 μs, then the delay time becomes 53.3 μs as a result of subtracting 2.2 μs from 55.5 μs. Consequently, as shown in FIG. 11, the CPU 65 measures the printing clock T1 and inputs the clock information of the printing clock T1 to the OR circuit 66 as the delay clock 1 with being delayed for 53.3 μs.

When the printing clock T2 measured after the printing clock T1 is 54.5 μs, then the delay time becomes 51.0 μs as a result of subtracting 4.5 μs from 55.5 μs. Consequently, the CPU 65 measures the printing clock T2 and inputs the clock information of the printing clock T2 to the OR circuit 66 as the delay clock T2 with being delayed for 51.0 μs.

When the printing clock T3 measured after the printing clock T2 is 54.3 μs, then the delay time becomes 50.1 μs as a result of subtracting 5.4 μs from 55.5 μs. Consequently, the CPU 65 measures the printing clock T3 and inputs the clock information of the printing clock T3 to the OR circuit 66 as the delay clock T1 with being delayed for 50.1 μs.

When either the delay clock 1 or the delay clock 2 is inputted to the OR circuit 66, the OR circuit 66 outputs the delay clock as a corrected printing clock and determines the ejection timings of the inkjet recording heads 32.

The ejection timings of the inkjet recording heads 32 determined by the corrected printing clocks generated in this example become faster than the ejection timings determined by the printing clocks before correction.

Next, an example where the intervals between the ejection timing-use marks 52 are spaced more roughly than the conveyance-direction resolution of the inkjet recording apparatus 10 will be described on the basis of FIG. 12.

In this example, it will be assumed that the ejection timing-use marks 52 are 200 dpi with respect to a printing resolution of 600 dpi.

First, when the detection signal is inputted from the home sensor 64 to the CPU 65, this triggers the CPU 65 to measure, as encoder timing clocks, the amount of time from when one of the ejection timing-use mark 52 passes the predetermined position to when the next ejection timing-use mark 52 passes the predetermined position.

Next, in the same manner as described above, the CPU 65 calculates the landing shift correction times for correcting the landing position shifts from the measured encoder timing clocks. The landing shift correction times are calculated by the expression: ((measured encoder timing clock÷set value of encoder timing clock value that has been set in advance)−1)× (the ejection distance from the surface of the paper P to the ejection face of the inkjet recording heads 32÷the ejection speed of the ink droplets). The set value of the encoder timing clock is 166.7 μs.

Figure 12:
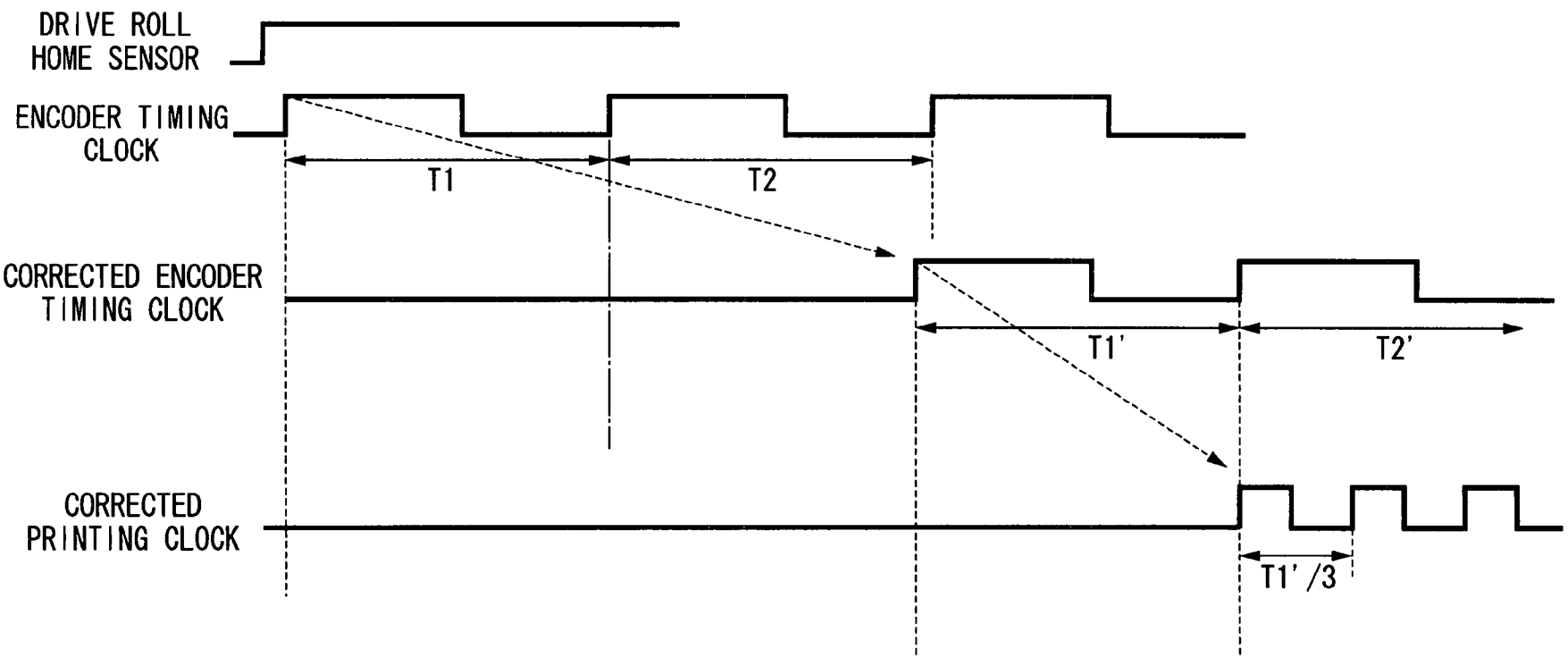
FIG. 12 is a diagram showing an example where intervals between ejection timing-use marks pertaining to the second embodiment are spaced more roughly than the conveyance-direction resolution of the inkjet recording apparatus.

Next, as shown in FIG. 12, the sets of clock information of the measured encoder timing clocks are delayed an amount of time equal to the sum of the landing shift correction time and the set value of the encoder timing clock and are alternately outputted from the CPU 65 as the delay clock 1 and the delay clock 2, whereby corrected encoder timing clocks are generated.

The CPU 65 triples the generated corrected encoder timing clocks with a tripler circuit and determines the ejection timings of the inkjet recording heads 32 as corrected printing clocks of the printing resolution of 600 dpi.

In this manner, in the present embodiment, the CPU 65 actually measures the printing clocks in real time and outputs the measured printing clock with being delayed at one printing clock which is determined by increasing or decreasing the landing shift correction times with respect to the set value of the printing clock (55.5 μs).

By increasing or decreasing the ejection timings of the inkjet recording heads 32 in amounts equal to the landing shift correction times, the shift amounts of the landing position of the ink droplets generated from when the ink droplets are ejected from the inkjet recording heads 32 to when the ink droplets land on the paper P can be made constant with respect to a reference position.

Thus, for example, even if the conveyance speed of the paper P varies at the time the ink droplets are ejected due to the drive roll 34 becoming eccentric, the positional shifts of the ink droplets landing on the paper P always become constant with respect to the reference position. For this reason, variations in image quality that arise between the pages of the paper P can be eliminated.

Because the conveyance speed of the conveyor belt 28 is measured and the ejection timings of the inkjet recording heads 32 are controlled in real time, the ejection timings of the inkjet recording heads 32 can be controlled by the landing shift correction times calculated by the current conveyance speed of the conveyor belt 28.

It will be noted that, although a conveyor belt is used as the conveyor unit in the preceding embodiments, the conveyor unit of the present invention is not limited to this and may also be a conveyor drum that is rotatingly driven, for example.

The present invention is not limited to the preceding exemplary embodiments; various modifications, changes and improvements are possible as long as they do not depart from the spirit of the present invention.

What is claimed is:

1. A liquid droplet ejection apparatus comprising:

a conveyor unit that conveys a recording medium;

a liquid droplet ejection head that records an image by ejecting liquid droplets onto the recording medium conveyed by the conveyor unit, the position of the recording medium facing the liquid droplet ejection head at points in time when the liquid droplets are ejected from the liquid droplet ejection head defining reference positions; and a controller that delays or advances ejection timings of the liquid droplet ejection head by amounts of a correction time duration calculated by:((a preset conveyance speed of the conveyor unit÷a conveyance speed of the conveyor unit actually measured −1))×(an ejection distance from a recording surface of the recording medium to an ejection face of the liquid droplet ejection heads÷an ejection speed of the liquid droplets), making the distance between the reference positions and positions where the liquid droplets land on the recording medium become substantially constant.

2. The liquid droplet ejection apparatus of claim 1, wherein the conveyance speed actually measured is measured before the recording of the image by the liquid droplet ejection heads.

3. The liquid droplet ejection apparatus of claim 1, wherein the controller adjusts the correction time in accordance with variations in the ejection distance between the recording surface of the recording medium and the ejection face of the liquid droplet ejection head that result from the type of the recording medium.

4. A liquid droplet ejection apparatus comprising:

a conveyor unit that conveys a recording medium;

a liquid droplet ejection head that records an image by ejecting liquid droplets onto the recording medium conveyed by the conveyor unit, the position of the recording medium facing the liquid droplet ejection head at points in time when the liquid droplets are ejected from the liquid droplet ejection head defining reference positions; and a controller that delays or advances ejection timings of the liquid droplet ejection head by amounts of a correction time duration determined based on conveyance speed data of the conveyor unit, making the distance between the reference positions and positions where the liquid droplets land on the recording medium become substantially constant;

the conveyor unit conveys the recording medium by the rotational force of a drive roll, and the controller retains conveyance speed profile data of the conveyor unit with respect to one rotation of the drive roll and a data table of the ejection timings of the liquid droplet ejection heads, calculates the correction time based on the conveyance speed profile data, and increases or decreases values in the data table by the calculated correction time, stores a modified data table, and causes the liquid droplet ejection head to eject the liquid droplets on the basis of the modified data table.

5. The liquid droplet ejection apparatus of claim 4, wherein the correction times are calculated by:

((the preset conveyance speed of the conveyor unit÷the actual conveyance speed of the conveyance speed profile data)−1)×(an ejection distance from the recording surface of the recording medium to the ejection face of the liquid droplet ejection heads÷the ejection speed of the liquid droplets).

6. The liquid droplet ejection apparatus of claim 1, wherein the conveyor unit includes marks added at substantially equidistant intervals, the liquid droplet ejection apparatus further comprises a detection unit that detects the marks, the controller comprises a calculation unit and a timing controller and:

holds in advance a reference clock of preset values of an ejection timing clock of liquid droplet ejection, and acquires a measured ejection timing clock of the intervals of time between the passing of each mark detected by the detection unit, the calculation unit calculates the correction time from the acquired measured ejection timing clock, and outputs the acquired ejection timing clock delayed by an amount of time equal to the sum of the correction time plus one period of the reference clock, and the timing controller controls the ejection timing of the liquid droplet ejection head on the basis of the output ejection timing clock.

7. The liquid droplet ejection apparatus of claim 6, wherein the correction time is calculated by:

((the acquired measured ejection timing clock÷the reference clock)−1)×(an ejection distance from the recording surface of the recording medium to the ejection face of the liquid droplet ejection heads÷the ejection speed of the liquid droplets).

* * * * *